United States Patent [19]

Bufalo

[11] Patent Number: 5,044,537

[45] Date of Patent: Sep. 3, 1991

[54] BACKPACK ORGANIZER APPARATUS

[76] Inventor: Jeffery P. Bufalo, R.D. #2 Box 443B, Pine Bush, N.Y. 12566

[21] Appl. No.: 519,826

[22] Filed: May 7, 1990

[51] Int. Cl.[5] ..... A45F 3/04

[52] U.S. Cl. ..... 224/245; 224/261; 220/4.27

[58] Field of Search ..... 224/191, 209, 210, 242, 224/245, 261, 153; 190/110, 111, 108; 150/113, 117; 206/545; 220/4.27

[56] References Cited

U.S. PATENT DOCUMENTS

| | | | |
|---|---|---|---|
| 2,118,323 | 5/1938 | Murphy | 190/110 |
| 3,623,634 | 11/1971 | Nogard | 220/4.27 |
| 3,861,504 | 1/1975 | McGraw | 190/110 |
| 4,082,208 | 4/1978 | Lane, Jr. | 220/4.27 |
| 4,673,117 | 6/1987 | Calton | 224/153 |

FOREIGN PATENT DOCUMENTS

| | | | |
|---|---|---|---|
| 893999 | 10/1953 | Fed. Rep. of Germany | 224/209 |

*Primary Examiner*—Renee S. Luebke
*Attorney, Agent, or Firm*—Leon Gilden

[57] ABSTRACT

An apparatus for use with and received within a cavity of an associated backpack, wherein the organizer includes a first housing, with a peripheral lip mounted thereabout securable to a second housing within a channel adjacent the floor of the second housing, with the second housing including a lid securable to the second housing overlying the floor of the second housing. The organizer apparatus is defined by a geometric configuration complementary to a cavity defined by the backpack. The invention further includes slidable drawers selectively positionable within compartments defined within the first housing.

1 Claim, 4 Drawing Sheets

PRIOR ART

BACKPACK ORGANIZER APPARATUS

BACKGROUND OF THE INVENTION

1. Field of the Invention

The field of invention relates to backpack apparatus, and more particularly pertains to a new and improved backpack organizer apparatus wherein the same is arranged for complementary reception within a cavity of an associated backpack.

2. Description of the Prior Art

Backpacks of various types have been provided in the prior art. Frequently during a backpacking endeavor, various items are desirably positioned within discrete chambers within associated backpacks. Backpack structure of the prior art has provided a plurality of separate pockets for securement of various articles therewithin, but have heretofore failed to provide an organization utilizing a unitary organizer positionable within a single cavity of a backpack chamber, as set forth by the instant invention. Examples of the prior art include U.S. Pat. No. 4,790,463 to Hansen providing a diver's bag for transporting articles under water, including various compartments formed within the bag.

U.S. Pat. No. 4,491,258 to Jones sets forth a backpack wherein a plurality of pockets are formed within the backpack, and utilizing a separate pocket mounted to an exterior surface of the backpack, wherein the separate pocket includes a plurality of chambers.

U.S. Pat. No. 4,449,655 to Germe sets forth a backpack and gear bag of a unitary construction defining several pockets therewithin.

U.S. Pat. No. 4,236,657 to Brunton sets forth a backpack utilizing shoulder straps and various flap portions overlying integral pockets formed within the backpack structure.

U.S. Pat. No. 3,902,640 to Geiben sets forth a backpack structure utilizing separate pockets and compartments formed within the backpack, as well as a removal top chamber formed to the backpack.

As such, it may be appreciated that there continues to be a need for a new and improved backpack organizer apparatus as set forth by the instant invention which addresses both the problems of ease of use, as well as effectiveness in construction in effectively compartmentalizing a unitary chamber of a backpack and in this respect, the present invention substantially fulfills this need.

SUMMARY OF THE INVENTION

In view of the foregoing disadvantages inherent in the known types of backpack apparatus now present in the prior art, the present invention provides a backpack organizer apparatus wherein the same sets forth a unitary housing of a predetermined configuration positionable within a backpack pocket of a complementary configuration. As such, the general purpose of the present invention, which will be described subsequently in greater detail, is to provide a new and improved backpack organizer apparatus which has all the advantages of the prior art backpack apparatus and none of the disadvantages.

To attain this, the present invention provides an apparatus for use with and received within a cavity of an associated backpack, wherein the organizer includes a first housing, with a peripheral lip mounted thereabout securable to a second housing within a channel adjacent the floor of the second housing, with the second housing including a lid securable to the second housing overlying the floor of the second housing. The organizer apparatus is defined by a geometric configuration complementary to a cavity defined by the backpack. The invention further includes sidable drawers selectively positionable within compartments defined within the first housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new improved backpack organizer apparatus which has all the advantages of the prior art backpack apparatus and none of the disadvantages.

It is another object of the present invention to provide a new and improved backpack organizer apparatus which may be easily and efficiently manufactured and marketed.

It is a further object of the present invention to provide a new and improved backpack organizer apparatus which is of a durable and reliable construction.

An even further object of the present invention is to provide a new and improved backpack organizer apparatus which is susceptible of a low cost of manufacture with regard to both materials and labor, and which accordingly is then susceptible of low prices of sale to the consuming public, thereby making such backpack organizer apparatus economically available to the buying public.

Still yet another object of the present invention is to provide a new and improved backpack organizer apparatus which provides in the apparatuses and methods of the prior art some of the advantages thereof, while simultaneously overcoming some of the disadvantages normally associated therewith.

Still another object of the present invention is to provide a new and improved backpack organizer apparatus wherein the same permits a separable organizer formed of a plurality of housings securable together and receivable within a unitary chamber of a backpack and removal selectively therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
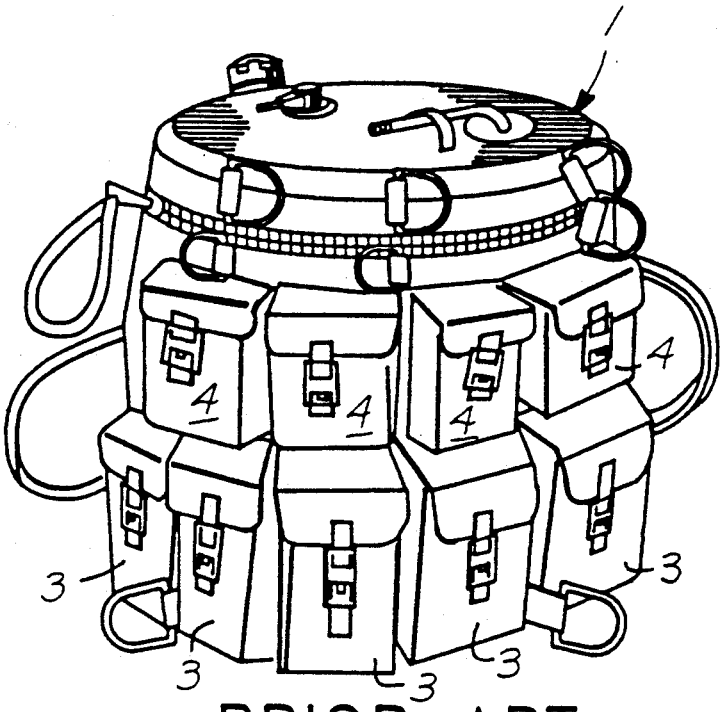
FIG. 1 is an isometric illustration of a prior art backpack apparatus.

With reference now to the drawings, and in particular to FIGS. 1 to 9 thereof, a new and improved backpack organizer apparatus embodying the principles and concepts of the present invention and generally designated by the reference numeral 10 will be described.

Figure 2:
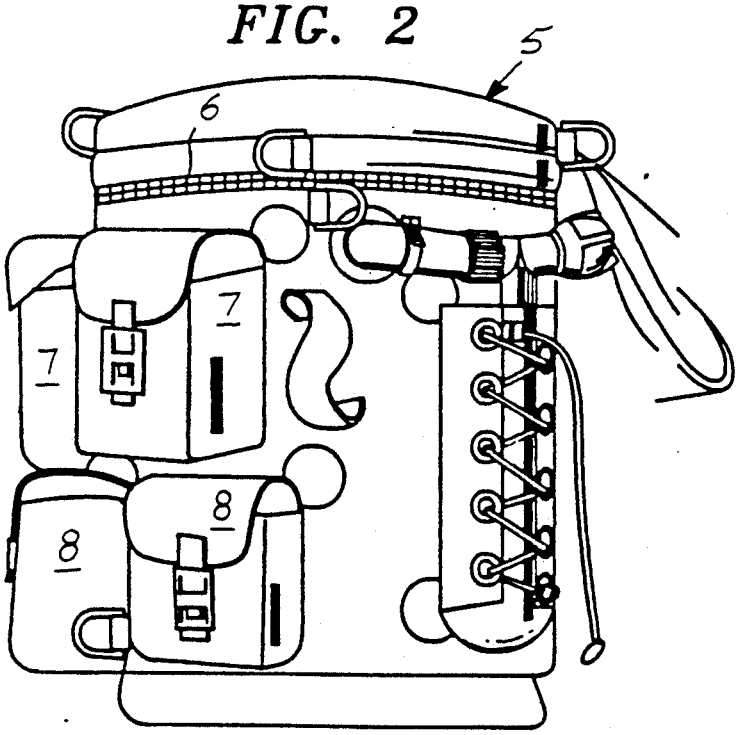
PRIOR ART FIG. 2
FIG. 2 is an isometric illustration of a further prior art backpack apparatus.
Figure 3:
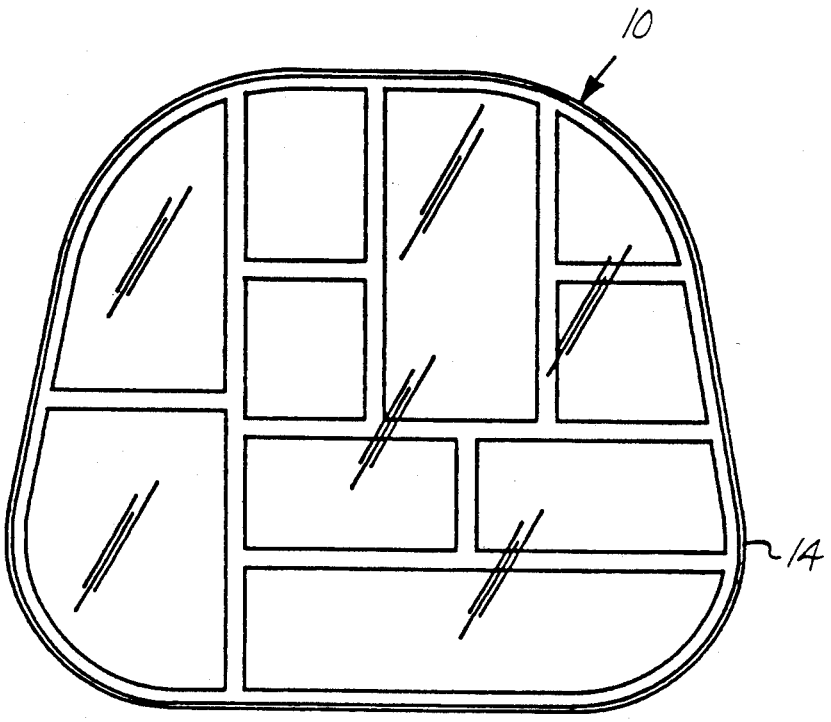
FIG. 3 is an orthographic top view of the instant invention.

FIG. 1 illustrates a prior art backpack 1 utilizing a first tier to first pockets 3, and a second tier of second pockets 4 to provide various compartments with an associated backpack, wherein the compartments are integrally mounted to the backpack strucuture. FIG. 2 illustrates a further prior art backpack apparatus 5 utilizing a zippered housing 6, with first and second series of pockets 7 and 8 respectively mounted to an exterior surface of the backpack organization.

Figure 5:
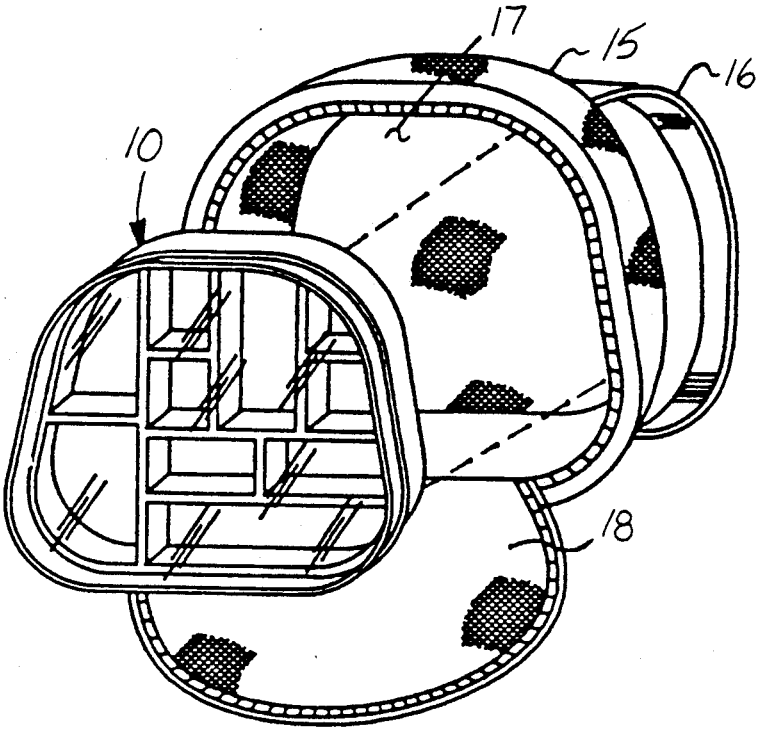
FIG. 5 is an isometric illustration, somewhat exploded to illustrate the apparatus in association with a backpack.
Figure 6:
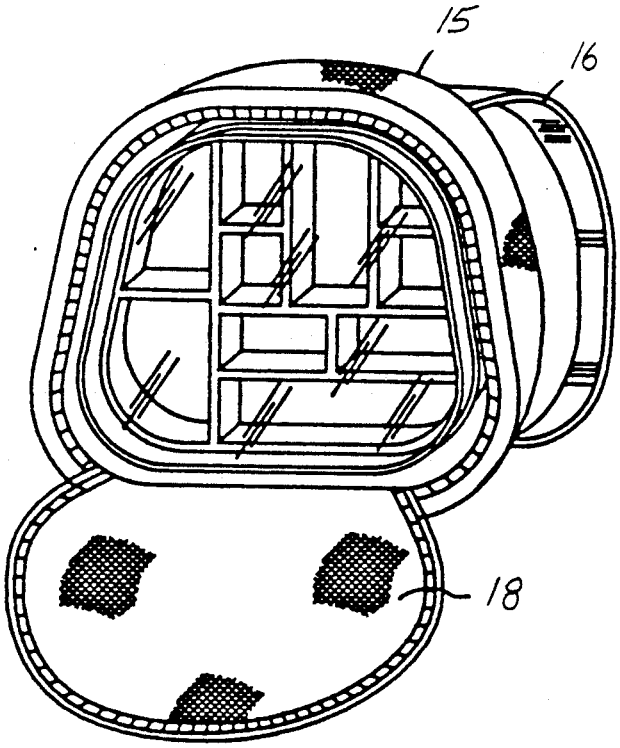
FIG. 6 is an isometric illustration of the organizer received within a complementary chamber of the backpack.
Figure 7:
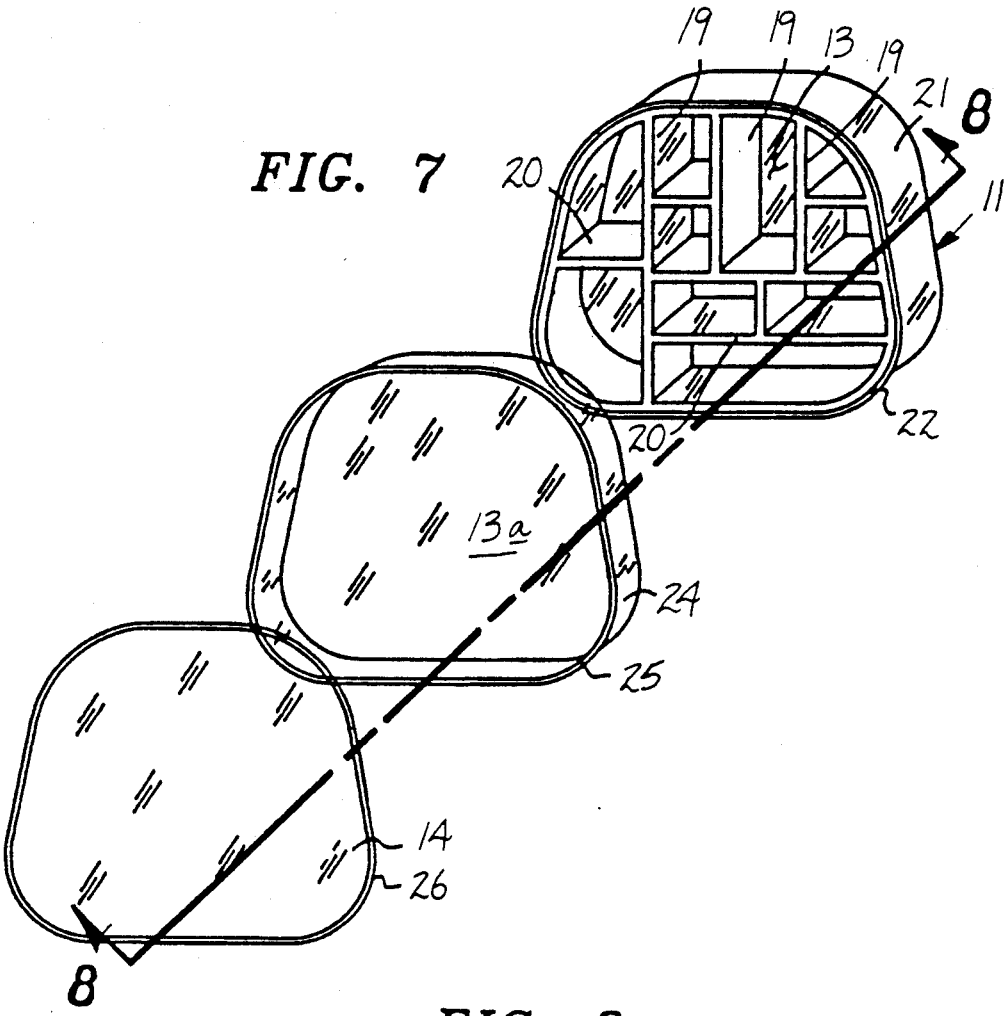
FIG. 7 is an isometric exploded illustration of the instant invention.
Figure 8:
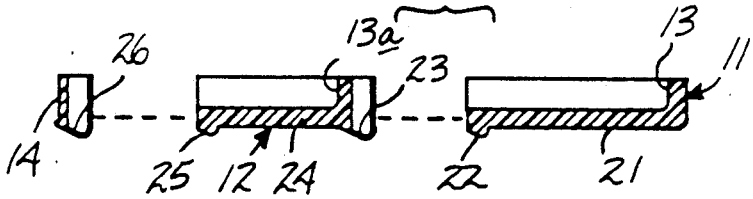
FIG. 8 is an orthographic view, taken along the lines 8—8 of FIG. 7, in the direction by the arrows.

More specifically, the backpack organizer apparatus 10 of the instant invention essentially comprises association with a backpack 15, as illustrated in FIGS. 5 and 6 for example. The organizer includes a first transparent housing container 11 selectively securable to an overlying second transparent housing container 12. A second housing container transparent lid 14 is selectively securable about the open upper end of the second housing 12 to fully enclose the second housing in a similar manner as the second housing fully encloses the first housing container 11. The first housing container 11 is defined by a first housing floor 13, with a first housing continuous and deformable side wall 21 orthogonally mounted integrally to the floor 13, wherein a second housing transparent floor 13*a* includes a second housing including a continuous and deformable transparent side wall 24 extending from the second housing floor 13*a*. The organizer, when secured together with the second housing secured to the first housing and the lid 14 secured to the second housing, defines a predetermined geometric configuration, wherein the backpack 15 includes a backpack cavity 17 defined by a cavity configuration complementary to the geometric configuration of the organizer, with the first housing container 11, the second housing container 12, and the lid 14 assembled together. A backpack cover flap 18 includes a continuous zipper to overlie the backpack cavity 17 to secure the organizer within the backpack. Further, securement loops 16 are formed to the backpack to permit transport of the backpack as required by an individual.

Figure 9:
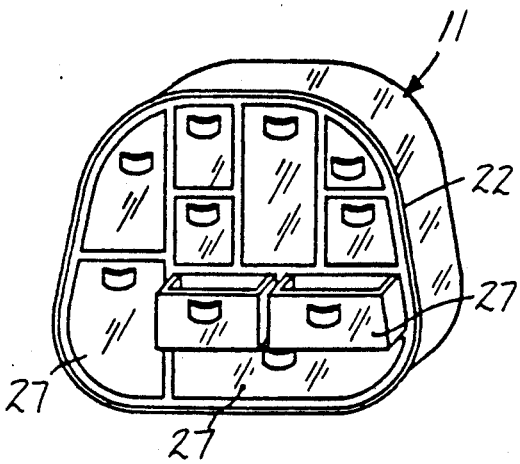
FIG. 9 is an isometric illustration of the first housing of the instant invention utilizing removable trays positionable within the various compartments of the first housing.

The first housing container 11 includes a plurality of parallel vertical walls orthogonally intersecting a plurality of horizontal walls to define a plurality of compartments therewithin of respective configurations in association with each compartment. FIG. 9 illustrates the first housing container 11 including a plurality of slidably mounted removable trays formed with handles and receivable within each of the compartments of the first housing container. The trays are completely removable to permit ease of placement and removal of various articles therewithin, and are selectively utilized with the first housing container.

Figure 4:
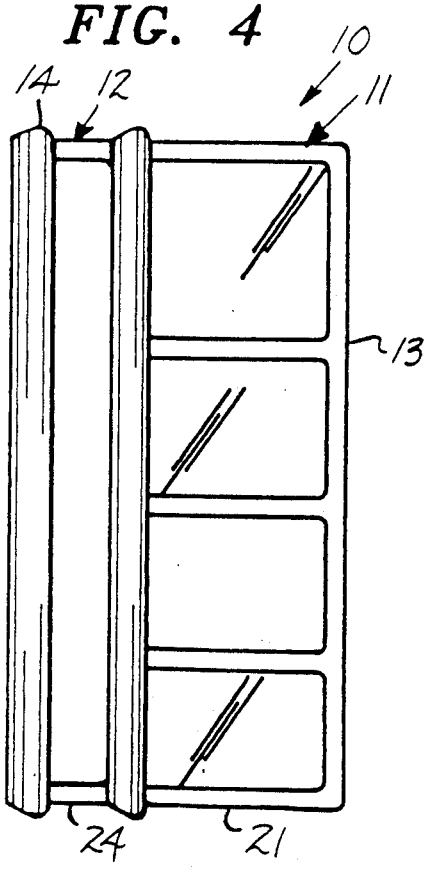
FIG. 4 is an orthographic side view, taken in elevation, of the instant invention.

The first housing container includes an outwardly extending deformable lip 22 extending outwardly of a top. terminal end portion of the first continuous and deformable side wall 21 of the first housing container spaced from the floor 13. The lip 22 defines a first lip of a first configuration receivable within a first channel 23. The first channel 23 is formed continuously about a lower terminal end of the second continuous side wall 24 and is of complementary configuration to that of the first lip 22 and is formed rearwardly and peripherally of the second housing side wall 24. Accordingly, the first lip 22 permits selective securement within the first channel 23 to permit securement of the first housing and second housing together in a manner as illustrated in FIGS. 4 and 5 for example. Further, the second housing 12 includes a second housing side wall lip defining a second lip formed continuously about an upper terminal end of the second side wall 24 spaced from the floor 13*a* and is receivable within a second channel 26 formed peripherally of the lid 14 to permit securement of the lid 14 about the upper terminal end of the second housing 12 to completely enclose the second housing 12. In this manner, the deformable lid 14 and associated deformable second channel 26 is selectively securable to the second lip 25, while the deformable first channel 23 is selectively securable about the first lip 22 to provide a unitary structure receivable within the backpack cavity 17 for transport of the organizer as required.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A backpack organizer apparatus in combination with a backpack, wherein the backpack includes a backpack cavity defined within the backpack..the backpack further includes a cover flap selectively overlying the cavity to enclose the cavity, the organizer includes:

a first housing container securable to a second housing container, the second container includes a lid, wherein the first container, the second container and the lid define a geometric configuration that is complementary to a configuration defined by the backpack cavity, and the first container, the second container and the lid are transparent, and the first container includes a floor and a continuous, deformable side wall, the side wall being integrally and orthogonally mounted to the first container floor, the first container further includes a first lip integrally mounted and extending exteriorly of a free end of the first container side wall, wherein the first lip is receivable within a first channel integrally mounted to the second container, and the second container includes a floor and a continuous, deformable side wall, the second container floor is integrally mounted adjacent an end of the second container side wall, the first channel also being located at the end of the second container side wall, and the second container side wall includes a second lip formed at a free end of the side wall, and the lid includes a lid channel, the lid channel complementarily receives the second lip therein, the lid channel being integrally formed about a peripheral surface of the lid, and the first container includes a plurality of first walls and a plurality of second walls, the first and second walls, are integrally mounted to the floor interiorly of the side wall to define a matrix of compartments therewithin, and each of the compartments includes a slidably mounted removable tray, each tray includes a handle mounted to a wall of the tray to permit selective removal and insertion of each tray within a compartment of the first container.

* * * * *